US009259831B2

(12) United States Patent
Boeck et al.

(10) Patent No.: US 9,259,831 B2
(45) Date of Patent: Feb. 16, 2016

(54) HAND POWER TOOL

(71) Applicant: Robert Bosch GmbH, Stuttgart (DE)

(72) Inventors: Cornelius Boeck, Kirchheim (DE); Joachim Schadow, Stuttgart (DE); Joerg Maute, Sindelfingen (DE); Florian Esenwein, Leinfelden-Echterdingen (DE); Manfred Lutz, Filderstadt (DE); Daniel Barth, Leinfelden-Echterdingen (DE)

(73) Assignee: Robert Bosch GmbH, Stuttgart, DE (US)

( * ) Notice: Subject to any disclaimer, the term of this patent is extended or adjusted under 35 U.S.C. 154(b) by 0 days.

(21) Appl. No.: 14/183,786

(22) Filed: Feb. 19, 2014

(65) Prior Publication Data

US 2014/0242888 A1 Aug. 28, 2014

(30) Foreign Application Priority Data

Feb. 22, 2013 (DE) ..... 10 2013 202 953

(51) Int. Cl.
*B24B 23/02* (2006.01)
*B25F 5/00* (2006.01)

(52) U.S. Cl.
CPC ..... *B25F 5/00* (2013.01); *B24B 23/028* (2013.01)

(58) Field of Classification Search
CPC ..... B24B 23/028; B24B 23/02; B25F 5/02; B25F 41/04; B25F 55/052; B25F 5/00
USPC ..... 451/5, 8, 344–359; 173/47, 13; 388/937
See application file for complete search history.

(56) References Cited

U.S. PATENT DOCUMENTS

| | | | | | |
|---|---|---|---|---|---|
| 3,327,196 | A | * | 6/1967 | Sahrbacker | 388/830 |
| 3,422,330 | A | * | 1/1969 | Swanke | 388/838 |
| 3,564,372 | A | * | 2/1971 | Vogelsberg et al. | 388/830 |
| 3,988,656 | A | * | 10/1976 | Schnizler et al. | 388/830 |
| 4,002,961 | A | * | 1/1977 | Chang | 388/838 |
| 4,513,381 | A | * | 4/1985 | Houser et al. | 700/168 |
| 4,536,688 | A | * | 8/1985 | Roger | 318/490 |
| 4,542,551 | A | * | 9/1985 | Phillips | 15/49.1 |
| 5,231,727 | A | * | 8/1993 | Armbruster | 15/97.1 |
| 5,315,790 | A | * | 5/1994 | Kish et al. | 451/5 |
| 5,466,183 | A | * | 11/1995 | Kirn et al. | 451/359 |
| 5,554,917 | A | * | 9/1996 | Kurz et al. | 318/805 |
| 6,129,618 | A | * | 10/2000 | Frech | 451/357 |
| 6,155,916 | A | * | 12/2000 | Rudolf et al. | 451/344 |
| 6,664,748 | B2 | * | 12/2003 | Kushida et al. | 318/139 |

(Continued)

FOREIGN PATENT DOCUMENTS

| | | |
|---|---|---|
| DE | 26 15 482 A1 | 10/1977 |
| DE | 40 04 463 A1 | 1/1991 |

(Continued)

*Primary Examiner* — George Nguyen
(74) *Attorney, Agent, or Firm* — Maginot, Moore & Beck LLP

(57) ABSTRACT

A hand power tool includes a drive unit, an electronic unit, and a switching unit. The switching unit includes at least one actuating element configured to activate and deactivate the drive unit. The switching unit also includes at least one switching element configured to be positioned in at least one first switching position to set at least one first operating mode. The at least one switching element is also configured to be positioned in at least one second switching position to set at least one second operating mode.

12 Claims, 3 Drawing Sheets

(56) References Cited

U.S. PATENT DOCUMENTS

| | | | | |
|---|---|---|---|---|
| 6,780,094 | B2 * | 8/2004 | Walker | 451/356 |
| 6,875,095 | B2 * | 4/2005 | Walker | 451/357 |
| 7,479,754 | B2 * | 1/2009 | Lucas et al. | 318/599 |
| 8,298,042 | B2 * | 10/2012 | Modler et al. | 451/8 |
| 8,732,896 | B2 * | 5/2014 | Lucas et al. | 15/319 |
| 2004/0053568 | A1 * | 3/2004 | Sieber | 451/357 |
| 2005/0075059 | A1 * | 4/2005 | Kausch et al. | 451/359 |
| 2005/0152759 | A1 * | 7/2005 | Allemann et al. | 409/181 |
| 2005/0280393 | A1 * | 12/2005 | Feldmann | 320/114 |
| 2006/0255754 | A1 * | 11/2006 | Rudolf et al. | 318/66 |
| 2010/0178856 | A1 * | 7/2010 | Cruz | 451/356 |
| 2012/0038175 | A1 * | 2/2012 | Tang et al. | 290/1 R |
| 2012/0135671 | A1 * | 5/2012 | Klabunde et al. | 451/358 |
| 2013/0165026 | A1 * | 6/2013 | Sugita et al. | 451/357 |
| 2014/0242888 | A1 * | 8/2014 | Boeck et al. | 451/358 |
| 2014/0305481 | A1 * | 10/2014 | Brandenburg et al. | 136/205 |
| 2015/0034348 | A1 * | 2/2015 | Yoshida et al. | 173/176 |

FOREIGN PATENT DOCUMENTS

| | | | |
|---|---|---|---|
| DE | 101 56 392 | A1 | 6/2003 |
| DE | 10 2008 000 704 | A1 | 10/2008 |
| JP | 2008-125296 | A | 5/2008 |

* cited by examiner

HAND POWER TOOL

This application claims priority under 37 U.S.C. §119 to application number DE 10 2013 202 953.5, filed on Feb. 22, 2013 in Germany, the disclosure of which is incorporated herein by reference in its entirety.

BACKGROUND

The disclosure is based on a hand power tool, in particular an angle grinder, having a drive unit and an electronic unit, and having a switching unit, which has at least one actuating element provided for activating and deactivating the drive unit, and which comprises at least one switching element that has at least one first switching position, for setting at least one first operating mode.

SUMMARY

It is proposed that the at least one switching element have at least one second switching position, for setting at least one second operating mode. A "drive unit" in this context is to be understood to mean, in particular, a unit provided, at least partially, to drive an insert tool coupled to the hand power tool, in an operating state. The drive unit preferably comprises at least one electric motor. It is also conceivable, however, for the drive unit to be realized, at least partially, such that it can be driven pneumatically and/or in another manner considered appropriate by persons skilled in the art.

An "electronic unit" in this context is to be understood to mean, in particular, a unit provided, at least partially, to control, in particular, the drive unit of the hand power tool, by open-loop and/or closed-loop control, at least when the hand power tool is in an operating state. Preferably, the electronic unit comprises at least one motor controller of the drive unit. The electronic unit preferably has electronic components such as, in particular, at least one transistor, at least one capacitor, at least one processor, particularly preferably at least one field-effect transistor (MOSFET) and/or at least one bipolar transistor, in particular having an insulated gate electrode (IGBT).

A "switching unit" in this context is to be understood to mean, in particular, a unit provided, at least partially, for active and controlled influencing of an operating state of the hand power tool by an operator of the hand power tool. "Provided" is to be understood to mean, in particular, specially programmed, configured and/or specially equipped. A "switching position" in this context is to be understood to mean, in particular, a spatial and variable alignment and/or position of the switching element relative to the drive unit, the electronic unit and/or another component of the hand power tool considered appropriate by persons skilled in the art, such as, in particular, relative to a housing.

The configuration according to the disclosure makes it possible to achieve a hand power tool that can preferably be used in a flexible manner and adapted to a respective application.

It is additionally proposed that the at least one switching element have at least one third switching position, for setting at least one third operating mode. It is thereby possible to achieve a hand power tool that has a preferably high degree of flexibility and that can preferably be used in a versatile manner.

It is furthermore proposed that the first operating mode comprise a normal operation, and the at least one second operating mode and/or the at least one third operating mode comprise an eco operating mode and/or a boost operating mode. A "normal operation" in this context is to be understood to mean, in particular, an operating state of the hand power tool that corresponds, at least partially, preferably at least mostly, and particularly preferably at least almost completely, to an operating and/or working mode of an already known hand power tool, and that is provided to enable continuous operation of the hand power tool. Preferably, there is made available in normal operation a maximum power of the drive unit that corresponds, in particular, to at least 80%, preferably at least 90%, preferably at least 100%, and particularly preferably at least 110% of a nominal power of the drive unit. In normal operation, the maximum power of the drive unit is, in particular, at most 125% of the nominal power of the drive unit. Preferably, the hand power tool, in normal operation, is provided for continuous operation.

An "eco operating mode" in this context is to be understood to mean, in particular, an operating mode of the hand power tool in which, at least at times, it is possible to achieve an efficiency of the hand power tool that, in particular, is at least 55%, preferably at least 60%, preferably at least 65%, and particularly preferably at least 70%, and/or that is provided, at least partially, for an energy-saving operating state of the hand power tool, and/or that is provided to optimize, at least at times, an energy consumption of the hand power tool, and/or in which an energy consumption of a consumer unit is reduced, at least partially. In the eco operating mode, the hand power tool, when in an operating or working state, has a maximum available energy consumption that, in particular, corresponds to less than 95%, preferably less than 90%, preferably less than 85%, and particularly preferably less than 80% of a maximum available energy consumption of the hand power tool in an operating and/or working state in normal operation, with the same and/or at least a similar type of operation. In a particularly preferred exemplary embodiment, the energy consumption of the hand power tool in an operating and/or working state in an eco operating mode corresponds to less than 70% of the energy consumption of the hand power tool in an operating and/or working state in normal operation.

A "boost operating mode" in this context is to be understood to mean, in particular, an operating mode of the hand power tool in which, at least at times, a power of the drive unit of, in particular, at least 130%, preferably at least 140%, preferably at least 150%, and particularly preferably at least 160% of the nominal power of the drive unit is made available. In a particularly preferred exemplary embodiment, a power of the drive unit that is at least 180% of the nominal power of the drive unit can be made available for a short time in the boost mode. "For a short time" in this context is to be understood to mean, in particular, less than 180 s, preferably less than 90 s, preferably less than 30 s, and particularly preferably less than 15 s. In normal operation, the hand power tool, when in an operating and/or working state, has a maximum available energy consumption that, in particular, corresponds to less than 95%, preferably less than 90%, preferably less than 85%, and particularly preferably less than 80% of a maximum available energy consumption of the hand power tool in an operating and/or working state in a boost operating mode, with the same and/or at least a similar type of operation. In normal operation, the hand power tool, in an operating and/or working state, can make available a lesser power than in a boost operating mode.

Also conceivable, however, are other operating modes considered appropriate by persons skilled in the art, such as, for example, a whisper operating mode, in which a reduced sound emission is realized in an operating state. It is thereby possible to achieve a hand power tool that can be used in a preferably flexible manner, and that is adapted to a respective application.

It is additionally proposed that the switching element and the actuating element be realized, at least partially, as a single piece. "As a single piece" is to be understood to mean, in particular, connected at least in a materially bonded manner, for example by a welding process, an adhesive process, an injection process and/or another process considered appropriate by persons skilled in the art, and/or, advantageously, formed in one piece such as, for example, by being produced from a casting and/or by being produced in a single or multi-component injection process and, advantageously, from a single blank. It is thereby possible, with simple configuration means, to achieve an advantageously small number, and small variation, of components, and thus a preferably inexpensive configuration of the hand power tool.

It is additionally proposed that the switching element be lockable in the first switching position and/or in at least one of the further switching positions. "Lockable" in this context is to be understood to mean, in particular, that the switching element, in particular mounted so as to be at least partially movable, can be fixed in position, arrested and/or blocked. An advantageously high degree of operating comfort can be achieved as a result.

It is additionally proposed that the switching element have at least one latching element, which is provided for locking the switching element in a first switching position and/or in at least one of the further switching positions. A "latching element" in this context is to be understood to mean, in particular, a resilient element that is provided to produce a, in particular, disconnectable latched connection, and that is provided to be deflected elastically, at least partially, when mounted. "Disconnectable" in this context is to be understood to mean, in particular, "non-destructively separable". It is thereby possible to achieve preferably simple locking of the switching element, and consequently an advantageously high degree of operating comfort.

It is furthermore proposed that the switching element and/or the operating element be constituted, at least partially, by a slide switch. It is thereby possible to achieve an advantageously simple, inexpensive and preferably robust configuration of the switching element.

Moreover, it is proposed that the switching element comprise at least one latching element, which, in the first switching position and/or in at least one of the further switching positions, constitutes, at least partially, a mechanical stop for limiting a switching travel of the actuating element. It is thereby possible to achieve an advantageously simple and preferably robust configuration of the switching unit.

It is additionally proposed that the drive unit comprise at least one EC motor. An "EC motor" in this context is to be understood to mean, in particular, a brushless, electrically commutated direct-current motor. It is thereby possible to achieve a preferably high-power, advantageously compact and inexpensive configuration of the drive unit of the hand power tool.

Also proposed is a switching unit of the hand power tool according to the disclosure.

The hand power tool according to the disclosure is not intended in this case to be limited to the application and embodiment described above. In particular, the hand power tool according to the disclosure may have individual elements, components and units that differ in number from a number stated herein, in order to fulfill a principle of function described herein.

BRIEF DESCRIPTION OF THE DRAWINGS

Further advantages are given by the following description of the drawing. The drawing shows three exemplary embodiments of the disclosure. The drawing and the description contain numerous features in combination. Persons skilled in the art will also expediently consider the features individually and combine them to create appropriate further combinations.

In the Drawing.

DETAILED DESCRIPTION

Figure 1A:
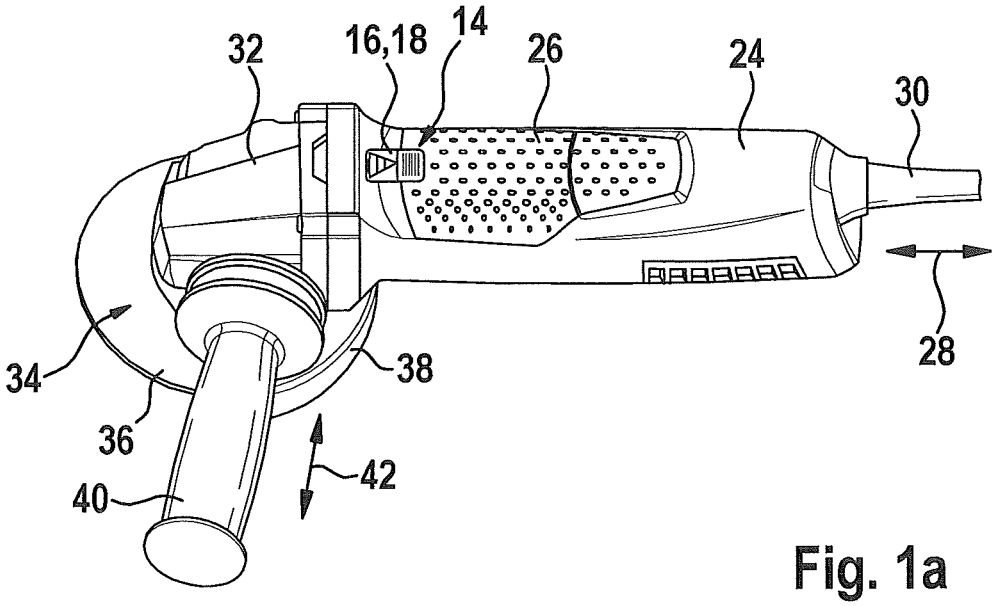
FIG. 1*a* shows a perspective view of a hand power tool according to the disclosure.

A hand power tool is represented in FIG. 1*a*. The hand power tool is constituted by an angle grinder. Also conceivable, however, are other configurations of the hand power tool considered appropriate by persons skilled in the art, such as, for example, as a power drill, hammer drill, oscillating hand power tool or orbital sander. The hand power tool comprises a housing 24. The housing 24 is made of a plastic. The housing 24 constitutes a main handle 26, which is provided to be gripped by an operating hand of an operator. A power cable 30 is disposed at one end of the housing 24, as viewed in the direction of main extent 28 of the hand power tool. The power cable 30 is provided to supply electrical energy to a drive unit 10 of the hand power tool. The power cable 30 is provided to be connected to an electrical power network. For this purpose, the power cable 30 has a plug element, not represented. It is also conceivable, however, for the hand power tool to be constituted by a battery-powered hand power tool. The hand power tool additionally has an actuating element 16, which is configured to be actuated by an operator. The actuating element 16 is provided for activating and deactivating the drive unit 10. The actuating element 16 is constituted by a slide switch.

The hand power tool additionally has a transmission housing 32. The transmission housing 32 is connected to the housing 24, at an end of the housing 24 opposite to the power cable 30. The transmission housing 32 is made of a metal. The transmission housing 32 is made of aluminum. The hand power tool comprises a tool receiver 34, not represented in greater detail, which is provided to receive and captively hold an insert tool 36. The insert tool 36 is constituted by an abrasive disc. The insert tool 36 is disconnectably connected to the tool receiver 34. The tool receiver 34 is disposed at an open end of the transmission housing 32, as viewed perpendicularly in relation to the direction of main extent 28 of the hand power tool. The tool receiver 34 projects out of the transmission housing 32. In addition, a protective hood 38 is coupled to the hand power tool. The protective hood 38 is disconnectably connected to a bearing flange of the hand power tool.

The hand power tool additionally has an ancillary handle 40. The ancillary handle 40 is provided to be gripped by a further operating hand of the operator. The ancillary handle 40 is disconnectably coupled to the hand power tool. When the ancillary handle 40 is mounted on the hand power tool, a direction of main extent 42 of the ancillary handle 40 is perpendicular to the direction of main extent 28 of the hand power tool and parallel to a plane of main extent of the insert tool 36.

The hand power tool has the drive unit 10, and the electronic unit 12, which is not represented in greater detail. The housing 24 of the hand power tool surrounds the drive unit 10 and the electronic unit 12. The drive unit 10 comprises an electric motor. The drive unit 10 comprises an EC motor. The drive unit 10 is connected to a drive shaft 44 via a transmission unit, which is not represented. The transmission unit comprises a bevel gear transmission. The drive shaft 44 is provided for driving the insert tool 36, which is coupled to the tool receiver 34. The drive shaft 44 is connected to the tool receiver 34 in a form-fitting and/or force-fitting manner. The drive shaft 44 is perpendicular to the direction of main extent 28 of the hand power tool.

The drive unit 10 is operatively connected to the electronic unit 12. The drive unit 10 is electronically connected to the electronic unit 12. The electronic unit 12 is provided for open-loop control or closed-loop control of the drive unit 10. Alternatively or additionally, the electronic unit 12 may also be provided for open-loop control or closed-loop control of a further functional unit considered appropriate by persons skilled in the art. The electronic unit 12 comprises field-effect transistors. The electronic unit 12 comprises metal-oxide semiconductor field-effect transistors (MOSFET). Alternatively or additionally, the electronic unit 12 may also comprise other electronic components considered appropriate by persons skilled in the art.

The hand power tool comprises a switching unit 14, which comprises the actuating element 16 and a switching element 18. The switching unit 14 is coupled to the electronic unit 12. The switching unit 14 is electronically connected to the electronic unit 12. The actuating element 16 is provided for activating and deactivating the drive unit 10. The switching element 18 and the actuating element 16 are realized as a single piece. The switching element 18 has a first switching position, which is provided for setting a first operating mode. The first operating mode comprises a normal operation of the hand power tool. The normal operation is configured in such a manner that the hand power tool can be operated over a long period of time. Moreover, the switching element 18 has a second switching position, which is provided for setting a second operating mode. The second operating mode comprises an eco operating mode of the hand power tool. When the hand power tool is operated in the eco operating mode, a greater efficiency of the hand power tool can be achieved than in normal operation. The switching element 18 additionally has a third switching position, which is provided for setting a third operating mode. The third operating mode comprises a boost operating mode of the hand power tool. When the hand power tool is operated in the boost operating mode, a greater power of the hand power tool can be achieved than in normal operation.

The switching element 18 of the switching unit 14 is constituted by a slide switch. The switching element 18 is disposed at an end of the main handle 26 that faces toward the transmission housing 32, as viewed in the direction of main extent 28 of the hand power tool. The switching element 18 is disposed on a side of the hand power tool that faces away from the tool receiver 34, as viewed perpendicularly in relation to the direction of main extent 28 of the hand power tool. Provided on the switching element 18 there is an identification marking, which is provided to provide an operator with information about the operating mode of the respective switching position. The identification marking comprises pictograms. It is also conceivable, however, for the identification marking to comprise inscribed lettering, numbering, a colored marking and/or another configuration of the identification marking considered appropriate by persons skilled in the art. For the purpose of switching over between the switching positions, an operator displaces the switching element 18, in an operating state, along the direction of main extent 28 of the hand power tool.

Figure 1B:
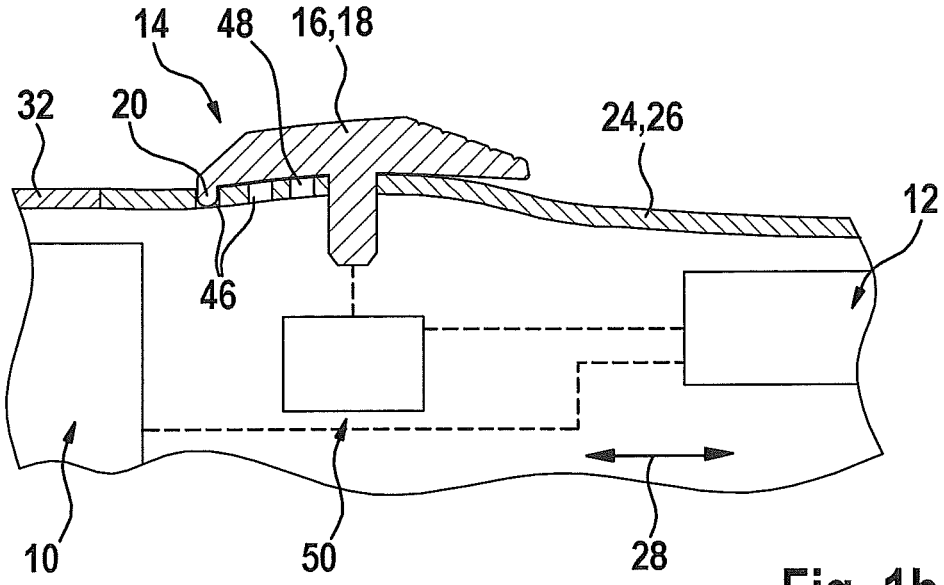
FIG. 1*b* shows a schematic sectional view of a portion of the hand power tool according to the disclosure.

The switching element 18 is realized so as to be lockable in the two of the three switching positions (FIG. 1*b*). The switching element 18 has a latching element 20, which is provided for locking the switching element 18 in the two switching positions. The latching element 20 is constituted by a latching projection or a latching lug. The latching element 20 corresponds with counter-latching elements 46, 48 of the switching unit 14. The counter-latching elements 46, 48 are each constituted by an opening. In total, three counter-latching elements 46, 48 are provided, with two of the counter-latching elements 46 being provided for locking the switching element 18 in the first switching position and in the second switching position, and one of the counter-latching elements 48 being provided for locking the switching element 18 in a latching position in which the drive unit 10 of the hand power tool is deactivated. In each case, one of the counter-latching elements 46 defines one of the switching positions. The third switching position can be attained by pressing the switching element 18 beyond the second switching position. It is also conceivable, however, for three counter-latching elements 46 to be provided, which each define one of the three switching positions.

The switching unit 14 comprises an electrical switch 50, not represented in greater detail, which is directly coupled to the switching element 18 and which is provided to forward the mechanical switching movement of the switching element 18 to the electronic unit 12, as an electronic signal. The electronic unit 12 controls the drive unit 10 according to this signal, and thereby makes available the operating mode set by means of the switching element 18. In the first switching position of the switching element 18, the electrical switch 50 releases a mains supply voltage, as a result of which the electronic unit 12 controls the drive unit 10 in a normal operating mode. In the second switching position of the switching element 18, the electrical switch 50 routes a first signal voltage to the electronic unit 12, such that the electronic unit 12 controls the drive unit 10 in an eco operating mode. The first signal voltage has a lesser value than the mains supply voltage. In the third switching position of the switching element 18, the electrical switch 50 routes a further signal voltage to the electronic unit 12, such that the electronic unit 12 controls the drive unit 10 in a boost operating mode. The further signal voltage has a lesser value than the mains supply voltage. The further signal voltage has a value differing from that of the first signal voltage. Also conceivable, however, are other configurations or assignments to the switching positions, considered appropriate by persons skilled in the art.

Figure 2A:
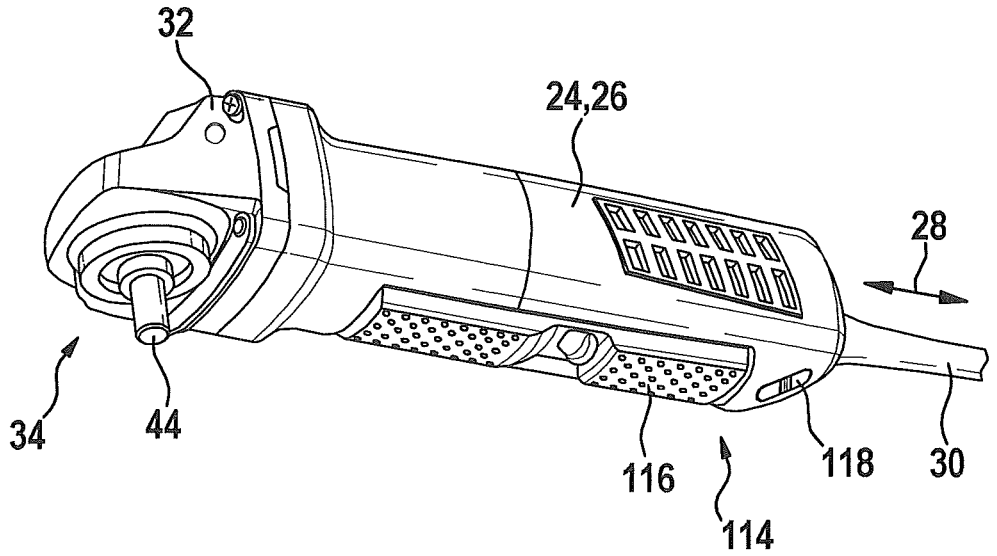
FIG. 2*a* shows a perspective view of an alternative configuration of the hand power tool according to the disclosure.

The following descriptions and the drawing are limited substantially to the differences between the exemplary embodiments and, in principle, reference may be made to the drawings and the description of the other exemplary embodiments, in particular to FIGS. 1*a* and 1*b*, in respect of components having the same designation, in particular in respect of components having the same reference numerals. In order to differentiate the exemplary embodiments, the number 1 has been prefixed to the reference numerals of the exemplary embodiment in FIGS. 2*a* and 2*b*, and the number 2 has been prefixed to the reference numerals of the exemplary embodiment in FIGS. 3*a* and 3*b*.

Figure 3A:
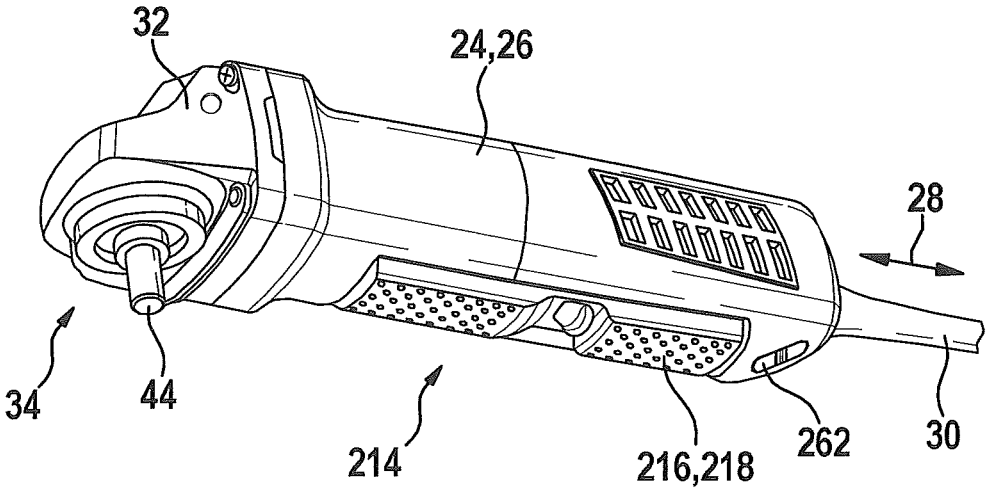
FIG. 3*a* shows a perspective view of a further, alternative configuration of the hand power tool according to the disclosure.

Represented in FIG. 3*a* is a hand power tool, which has a drive unit 10, an electronic unit 12 and a switching unit 114, and which corresponds for the most part to the hand power tool already described. The switching unit 114 has an actuating element 116, which is provided for activation and deactivation of the drive unit 10 by an operator of the hand power tool. The actuating element 116 is realized as a tripping latch. The actuating element 116 is disposed on a side of a housing 24 that faces toward a tool receiver 34, as viewed perpendicularly in relation to a direction of main extent 28 of the hand power tool. For the purpose of activating the drive unit 10, an operator of the hand power tool presses the actuating element 116 inward. Release of the actuating element 116 causes the drive unit 10 to be deactivated.

The switching unit 114 additionally comprises a switching element 118, which is provided for switching over between differing operating modes. The switching element 118 is disposed behind the actuating element 116, as viewed from the tool receiver 34 toward a power cable 30, in the direction of main extent 28 of the hand power tool. The switching element 118 is constituted by a slide switch. The switching element 118 has a first switching position, which is provided for setting a normal operation of the hand power tool in an operating state. The switching element 118 has a second switching position, which is provided for setting an eco operating mode of the hand power tool in an operating state. The second switching position of the switching element 118 may also be provided for setting a boost operating mode or a whisper operating mode of the hand power tool in an operating state. Moreover, it is conceivable for the switching element 118 to have yet further, additional switching positions for setting further operating modes considered appropriate by persons skilled in the art.

Figure 2B:
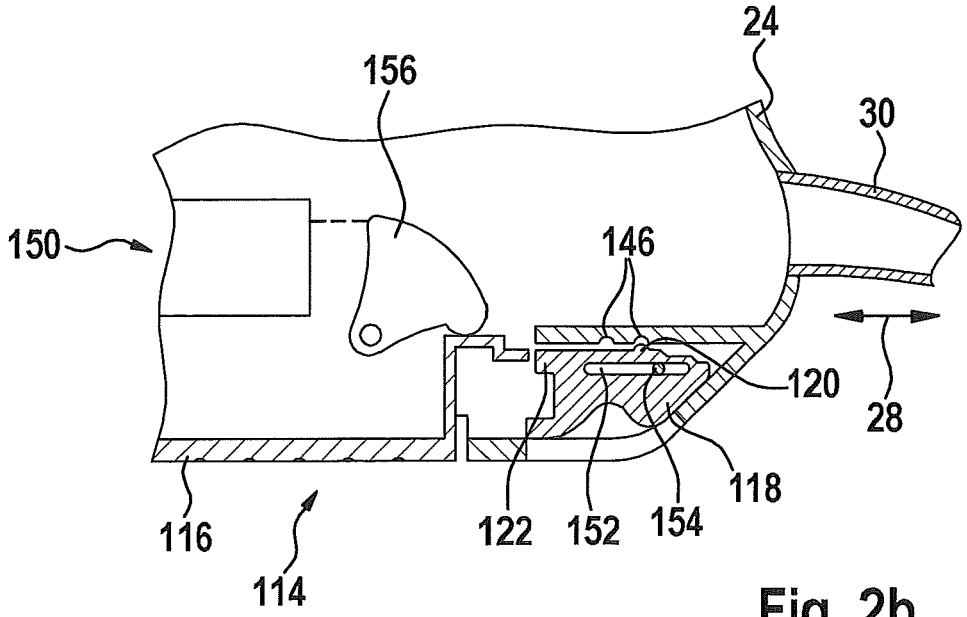
FIG. 2*b* shows a schematic sectional view of a portion of the alternatively configured hand power tool.
Figure 3B:
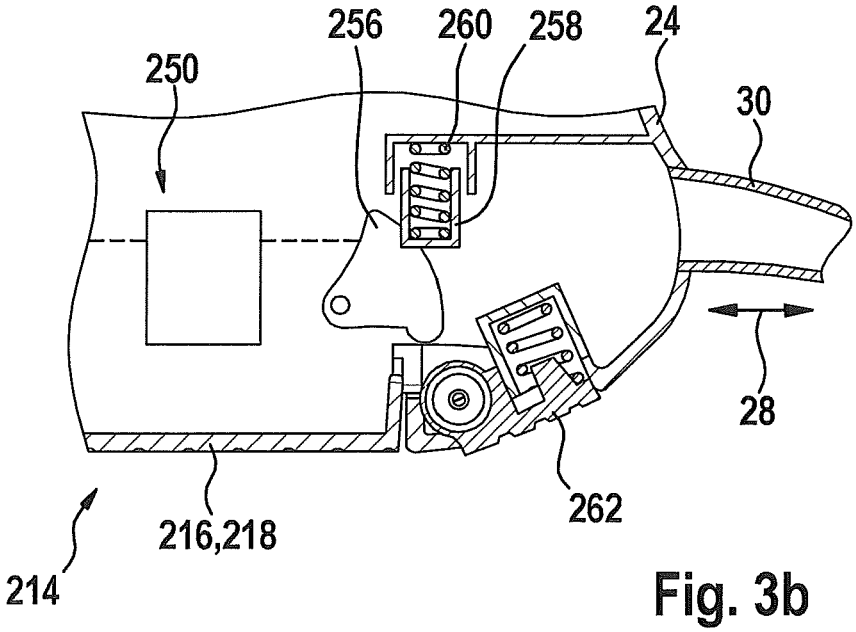
FIG. 3*b* shows a schematic sectional view of a portion of the further, alternatively configured hand power tool.

The switching element 118 is realized so as to be lockable in the two switching positions (FIG. 2*b*). The switching element 118 has a latching element 120, which is provided for locking the switching element 118 in the two switching positions. The latching element 120 is constituted by a latching projection or a latching lug. The latching element 120 corresponds with counter-latching elements 146 of the switching unit 114. The counter-latching elements 146 are each constituted by a recess. In total, two counter-latching elements 146 are provided, which are provided for locking the switching element 118 in the first switching position and in the second switching position. In each case, one of the counter-latching elements 146 defines one of the switching positions.

The switching element 118 is displaceably mounted, as viewed in the direction of main extent 28 of the hand power tool. The switching element 118 has a groove 152, in which a fixedly disposed guide pin 154 engages, and which constitutes a guide of the switching element 118 in the direction of main extent 28 of the hand power tool. For the purpose of switching over between the switching positions, an operator of the hand power tool displaces the switching element 118 along the direction of main extent 28 of the hand power tool. The counter-latching elements 146 are disposed in succession, as viewed in the direction of main extent 28 of the hand power tool. The switching element 118 has a stop element 122, which is provided to constitute a mechanical stop, for the purpose of limiting the switching travel of the actuating element 116, in a second switching position of the switching element 118. The stop element 122 is realized so as to constitute a single piece with the switching element 118. The stop element 122 is disposed on a side of the switching element 118 that faces toward the actuating element 116.

In a first switching position of the switching element 118, the switching element 118 is disposed in a position that faces toward the power cable 30. In the case of this position of the switching element 118, the actuating element 116, upon an actuation by an operator of the hand power tool, has a maximum switching travel perpendicularly in relation to the direction of main extent 28 of the hand power tool. In a second switching position of the switching element 118, the switching element 118 is disposed in a position that faces toward the actuating element 116.

In a second switching position of the switching element 118, the actuating element 116, upon an actuation of the actuating element 116 by an operator, strikes against the stop element 122 of the switching element 118, thereby limiting the switching travel of the actuating element 116. In the second switching position of the switching element 118, the maximum possible switching travel of the actuating element 116 is shorter than in the first switching position of the switching element 118.

The switching unit 114 comprises an electrical switch 150, not represented in greater detail, which is indirectly coupled to the actuating element 116 via a converter element 156. The converter element 156 is provided for converting a movement of the actuating element 116 and transmitting the switching movement of the actuating element 116 to the electrical switch 150. The electrical switch 150 is provided to forward the mechanical switching movement of the converter element 156 to the electronic unit 12, as an electronic signal. The electronic unit 12 controls the drive unit 10 according to this signal, and thereby makes available the operating mode set by means of the switching element 118.

Represented in FIG. 3*a* is a hand power tool, which has a drive unit 10, an electronic unit 12 and a switching unit 214, and which corresponds for the most part to the hand power tool already described. The switching unit 214 has an actuating element 216, which is provided for activation and deactivation of the drive unit 10 by an operator of the hand power tool. The actuating element 216 is realized as a tripping latch. The actuating element 216 is disposed on a side of a housing 34 that faces toward a tool receiver 34, as viewed perpendicularly in relation to a direction of main extent 28 of the hand power tool.

The switching unit 214 comprises an electrical switch 250, not represented in greater detail, which is coupled to a converter element 256. The converter element 256 is provided for converting a movement of the actuating element 216 and transmitting the switching movement of the actuating element 216 to the electrical switch 250. The electrical switch 250 is provided to forward the mechanical switching movement of the converter element 256 to the electronic unit 12, as an electronic signal. The electronic unit 12 controls the drive unit according to this signal, and thereby makes available the set operating mode.

The switching unit 214 additionally comprises a switching element 218, which is provided for switching over between differing operating modes. The switching element 218 is realized so as constitute a single piece with the actuating element 216. The switching element 218 has a first switching position and a second switching position. The first switching position is provided for setting a normal operation of the hand power tool in an operating state. In order to bring the switching element 218 into the first switching position, an operator presses the switching element 218 inward, perpendicularly in relation to the direction of main extent 28. The linear switching movement of the switching element 218 causes the converter element 256 to be actuated. The converter element 256 in this case pivots about a rotation axis. The switching unit 214 has a push element 258, on which the converter element 256 impinges. The push element 258 is mounted so as to be displaceable against a spring element 260. The spring element 260 is constituted by a compression spring. The spring element 260 comprises a helical compression spring. In the first switching position of the switching element 218, the converter element 256 bears against the push element 258 without compressing the spring element 260. Through the spring element 260, which loads the push element 258, the operator of the hand power tool perceives a resistance when pressing the switching element 218.

The switching element 218 has the second switching position, which is provided for setting an eco operating mode of the hand power tool in an operating state. The second switching position of the switching element 218 may also be provided for setting a boost operating mode or a whisper operating mode of the hand power tool in an operating state. Moreover, it is conceivable for the switching element 218 to have yet further, additional switching positions for setting further operating modes considered appropriate by persons skilled in the art. In order to bring the switching element 218 into the second switching position, an operator, after having attained the first switching position, presses the switching element 218 further inward, against the spring force of the spring element 260 that acts upon the push element 258, perpendicularly in relation to the direction of main extent 28. The linear switching movement of the switching element 218 causes the converter element 256 to be pivoted further about the rotation axis, and thereby displaces the push element 258 against the spring force of the spring element 260. The spring element 260 is thereby compressed.

In the first switching position of the switching element 218, the electrical switch 250 releases a mains supply voltage, as a result of which the electronic unit 12 controls the drive unit 10 in a normal operating mode. In the second switching position of the switching element 218, the electrical switch 250 routes a signal voltage to the electronic unit 12, such that the electronic unit 12 controls the drive unit 10 in an eco operating mode. The signal voltage has a lesser value than the mains supply voltage. Also conceivable, however, are other configurations or assignments to the switching positions, considered appropriate by persons skilled in the art. Release of the actuating element 216 causes the drive unit to be deactivated.

The switching unit 214 additionally has a locking element 262. The locking element 262 is disposed behind the actuating element 216, as viewed from the tool receiver 34 toward a power supply cable 30, in the direction of main extent 28 of the hand power tool. The locking element 262 is provided to mechanically lock the switching element 218 in a switching position.

What is claimed is:

1. A hand power tool, comprising:
a drive unit;
an electronic unit; and
a switching unit, including:
at least one actuating element configured to activate and deactivate the drive unit; and
at least one switching element configured to be positioned in at least one first switching position to set at least one first operating mode and configured to be positioned in at least one second switching position to set at least one second operating mode,
wherein at least one stop element is formed on the at least one switching element and is configured to mechanically stop travel of the at least one actuating element when the at least one switching element is positioned in at least one of the at least one first switching position and the at least one second switching position.

2. The hand power tool according to claim 1, wherein the at least one switching element is configured to be positioned in at least one third switching position to set at least one third operating mode.

3. The hand power tool according to claim 1, wherein:
the first operating mode includes a normal operation, and
at least one of the at least one second operating mode and the at least one third operating mode includes at least one of an eco operating mode and a boost operating mode.

4. The hand power tool according to claim 1, wherein the at least one switching element and the at least one actuating element are configured, at least partially, as a single piece.

5. The hand power tool according to claim 1, wherein the at least one switching element is configured to be locked in at least one of the at least one first switching position and at least one of the at least one second switching position and the at least one third switching position.

6. The hand power tool according to claim 2, wherein the at least one switching element has at least one latching element configured to lock the switching element in at least one of the at least one first switching position and at least one of the at least one second switching position and the at least one third switching position.

7. The hand power tool according to claim 1, wherein at least one of the at least one switching element and the at least one actuating element includes a slide switch.

8. The hand power tool according to claim 2, wherein the at least one stop element is configured to mechanically stop travel of the at least one actuating element when the at least one switching element is positioned in at least one of the at least one first switching position and at least one of the at least one second switching position and the at least one third switching position.

9. The hand power tool according to claim 1, further comprising a drive unit including at least one EC motor.

10. The hand power tool according to claim 1, wherein the hand power tool is an angle grinder.

11. A hand power tool, comprising:
a drive unit;
an electronic unit; and
a switching unit, including:
at least one actuating element configured to activate and deactivate the drive unit; and
at least one switching element configured to be positioned in at least one first switching position to set at least one first operating mode, positioned in at least one second switching position to set at least one second operating mode, and positioned in at least one third switching position to set at least one third operating mode,
wherein the at least one switching element has at least one latching element configured to lock the switching element in at least one of the at least one first switching position and at least one of the at least one second switching position and the at least one third switching position.

12. A switching unit of a hand power tool, the switching unit comprising:
at least one actuating element configured to activate and deactivate a drive unit of the hand power tool;
at least one switching element configured to be positioned in at least one first switching position to set at least one first operating mode and configured to be positioned in at least one second switching position to set at least one second operating mode;

an electrical switch;

a converter element coupled to the electrical switch and configured to convert a movement of the at least one actuating element to the electrical switch; and a locking element configured to mechanically lock the at least one switching element in at least one of the at least one first switching position and the at least one second switching position.

* * * * *